US005944307A

United States Patent [19]

Yim

[11] Patent Number: 5,944,307

[45] Date of Patent: Aug. 31, 1999

[54] FINGER DEVICE FOR FEED CASSETTE USING COMMON PRINTING PAPERS

[75] Inventor: Gwang-Pyo Yim, Suwon, Rep. of Korea

[73] Assignee: SamSung Electronics Co., Ltd., Suwon, Rep. of Korea

[21] Appl. No.: 08/813,983

[22] Filed: Mar. 10, 1997

[30] Foreign Application Priority Data

Mar. 8, 1996 [KR] Rep. of Korea ..... 96-4255

[51] Int. Cl.[6] ..... B65H 1/24

[52] U.S. Cl. ..... 271/170; 271/167; 271/169

[58] Field of Search ..... 271/160, 167, 271/169, 170, 19, 20, 21

[56] References Cited

U.S. PATENT DOCUMENTS

| | | | |
|---|---|---|---|
| 3,385,643 | 5/1968 | Adell | 312/348 |
| 4,288,137 | 9/1981 | MacDonald | 312/341 |
| 4,623,137 | 11/1986 | Irie et al. | 271/160 |
| 5,232,214 | 8/1993 | Matsuura et al. | 271/127 |
| 5,417,490 | 5/1995 | Hobbs et al. | 312/334.47 |
| 5,419,544 | 5/1995 | Ono et al. | 271/164 |
| 5,443,252 | 8/1995 | Morinaga et al. | 271/127 |
| 5,490,724 | 2/1996 | Domenig | 312/334.45 |
| 5,542,759 | 8/1996 | Krivec | 312/334.44 |

*Primary Examiner*—Donald P. Walsh
*Assistant Examiner*—Brett C. Martin
*Attorney, Agent, or Firm*—Robert E. Bushnell, Esq.

[57] ABSTRACT

A finger device freely loads the printing papers in a feed cassette. The finger apparatus includes a conductor protrusion coupled to a paper sensor at one side of a body where the cassette is attached and detached. The finger is supported by a pin and spring in the feed cassette for separating with a tray portion of the feed cassette. A finger portion of the finger apparatus can be located at an edge of the feed cassette by the projection of the body, upon the feed cassette being attached. The finger portion can automatically separate the feed cassette using a stability of the spring upon the cassette being detached from the body.

14 Claims, 3 Drawing Sheets

FINGER DEVICE FOR FEED CASSETTE USING COMMON PRINTING PAPERS

CLAIM OF PRIORITY

This application makes reference to, incorporates the same herein, and claims all benefits accruing under 35 U.S.C. § 119 from an application entitled Finger Device for Feed Cassette Using Common Printing Papers earlier filed in the Korean Industrial Property Office on Mar. 8, 1997, and there duly assigned Serial No. 4255/1996 by that Office.

BACKGROUND OF THE INVENTION

1. Field of the Invention

The present invention relates generally to printers having feed cassette using common printing papers. More particularly, the present invention relates to devices for separating and installing the feed cassette.

2. Description of the Related Art

Typically, the art provides with a finger device (which can sometimes be a latch) for separating the printing papers into each individual papers and feeding the separated papers in a feed cassette loaded with a lot of printing papers. In most such situations, the finger device is installed to both edges of one side in the feed cassette. To study the contemporary practice, one may Adell (U.S. Pat. No. 3,385,643, Stereo Tape Cartridge Container, May 28, 1968) discussing a container that has a top, bottom, back and two side walls with an open front. The walls and ledges are spaces such that pressure can be provided on the holders so that they can be retained against movement to prevent their rattling within the area assisted by the lock provided by the detent when disposed within the notch. MacDonald (U.S. Pat. No. 4,288,137, Drawer Slide System, Sep. 8, 1981) discusses a drawer slide system in which cooperating rollers and tracks are mounted to the sides of the drawer and to the frame of the cabinet in which the drawer is mounted. The indent at forward end of the drawer rail serves as a stop for keeping the drawer closed and, when the drawer is shut and the rails in the position, the cabinet rail roller will engage the indent to hold the drawer shut. Krivec (U.S. Pat. No. 5,542,759, Shock Absorbing Disconnect Latch For Drawing Slides, Aug. 6, 1996) discusses a disconnect latch that is provided for use with a drawer slide assembly of the type including an elongated member and a stopper for limiting longitudinal travel of the elongated drawer member. Hobbs et al. (U.S. Pat. No. 5,417,490, Telescoping Slide Assembly, May 23, 1995) discusses a drawer guide for supporting a moveable structure such as a drawer in a furniture article which includes a guide rail having a rotatable guide rail roller. The pull-out rail is provided with a pull-out rail retaining member engaging the guide rail roller in a rearward position of the pull-out rail resisting forward movement of the pull-out rail. Domenig (U.S. Pat. No. 5,490,724, Drawer Guide For Supporting A Moveable Structure Such As A Drawer In A Furniture Article, Feb. 13, 1996) discusses a drawer guide for supporting a moveable structure such as a drawer in a furniture article. The furniture article includes a guide rail and a pull-out rail. Morinaga et al. (U.S. Pat. No. 5,443,252, Sheet Supplying Apparatus For Feeding Sheets From Cassettes Having Different Sheet Holding Capacities, Aug. 22, 1995) discusses a sheet supply apparatus having a sheet container for stacking and supporting sheets. The apparatus can have supply rollers with a flat cut-out . Note that the supply rollers are partly circular. The sheet supply rollers are normally kept stationary so that the flat cut-outs of the rollers face downwardly. Matsuura et al. (U.S. Pat. No. 5,232,214, Paper Supplying Apparatus And Method Using A Detachable Cassette, Aug. 3, 1993) discusses a paper supply device for supplying paper sheets to an image forming portion of an image forming apparatus, which include a cassette attachable to the body of the image forming apparatus. Paper supply roller is disposed above and proximate to insertion port of receiving portion and makes contact with the uppermost sheet in paper cassette Irie et al. (U.S. Pat. No. 4,623,137, Paper Feeder Equipped With Copying Paper Cassettes, Nov. 18, 1986) discusses a paper feeder equipped with copying paper cassettes having a cassette receiving section within the housing of a copying apparatus for mounting thereon a plurality of copying paper cassettes containing sheets of copying paper having different sizes. Ono et al. (U.S. Pat. No. 5,419,544, Paper Cassette And Paper Cassette Insertion Mechanism, May 30, 1995) discusses a paper cassette having a paper stack tray provided on a cassette body, a stack tray locking mechanism for locking the paper stack tray and releasing the lock when the cassette is inserted into the cassette receptacle, and a first restoring member for pushing the paper stack tray toward a supply roller and bringing the paper when the lock of the stack tray locking mechanism is released. Based on my study of these exemplars of the contemporary practice and the art, I find that there is a need for an effective and improved printers having feed cassette using common printing papers that incorporate devices for freely loading the printing papers in the feed cassette, when the feed cassette is separated from housing of the image formation unit.

SUMMARY OF THE INVENTION

Thus, it is an object of the present invention to provide improved printers having feed cassette using common printing papers.

Another object is to provide an improved device for freely loading the printing papers in the feed cassette upon the feed cassette being separated from housings of apparatuses capable of installing the feed cassette.

Another object of the present invention to provide a finger device for freely loading the printing papers in a feed cassette when the feed cassette is separated from housings of an apparatus capable of having the feed cassette, whereby the printing papers can be easily picked up and an insertion of the cassette can be sensed upon installing the finger device at the feed cassette.

To accomplish the above object, the present invention is provided with the finger device that works with a printer apparatus. The body of the printer apparatus includes a conductor protrusion coupled to a paper sensor at one side of a body where the cassette is attached and detached. The finger is supported by a pin and a spring in the feed cassette for separating with a tray portion of the feed cassette. A finger portion of the finger apparatus becomes located at an edge of the feed cassette nearby the protrusion of the body, upon attaching the feed cassette for separating automatically the finger. This occurs because of a stability of the spring ("a recoil") existing upon detaching the cassette from the body.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
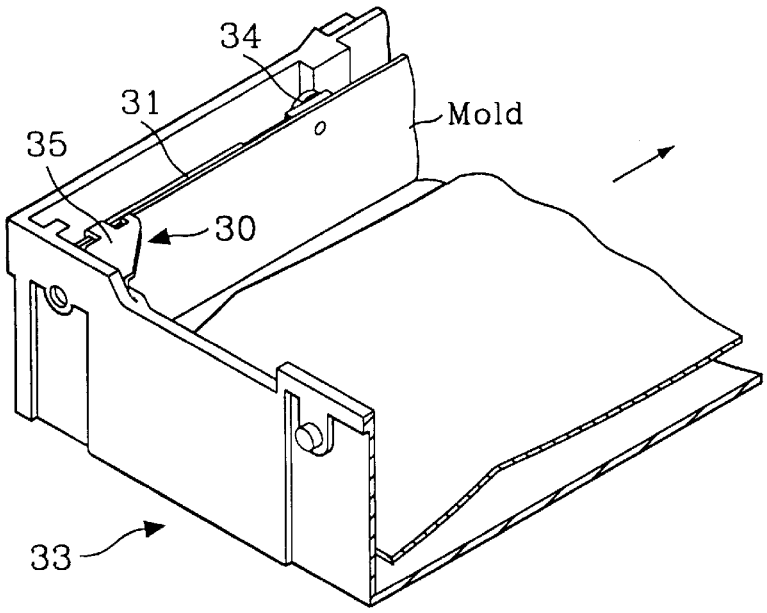
(PRIOR ART) Fig. 1
FIG. 1 is a perspective view showing a typical finger device of the contemporary practice.

Turning now to the drawings, FIG. 1 is a perspective view showing a typical finger device of the contemporary practice. The finger device has a molded wall, where a pin 34 is formed at a rear end of one portion of a detaining board 31 to be inserted into a hole of the feed cassette 33 and a finger 35 is formed in a format of a triangle by bending at a front end of one portion of the detaining board 31, thereby covering an upper portion of the feed cassette 33. Upon installing the finger device to the feed cassette 33, the detaining board 31 of the finger device 30 is located between the mold of the feed cassette 33 and a housing thereof, and the pin 34 is inserted into a hole formed on the mold. At this time, the finger device 30 is fixed at the edge of the feed cassette 33 and the finger 35 covers the upper portion of the edge of the feed cassette 33. In situations where common printing papers are loaded in the feed cassette 33 having the above finger device, it is required to push the rear portion of the detaining board 31 on the basis of the pin 34 of the finger device 30. Thus, it is required to lift the finger 35 at a small angle, so that the printing papers can be freely loaded in the feed cassette 33. Because the lift angle of the finger 35 is an acute angle and the direction for lifting the finger 35 is same as that for loading the printing papers in the feed cassette 33, the printing papers can not freely be loaded therein. Also, because it is impossible to fix the finger 35 and maintain the detaining state of the finger 35 upon imposing an impact on the feed cassette, the position of the finger 35 is changed. Obviously, this causes an inconvenience in loading the printing papers therein.

Figure 2:
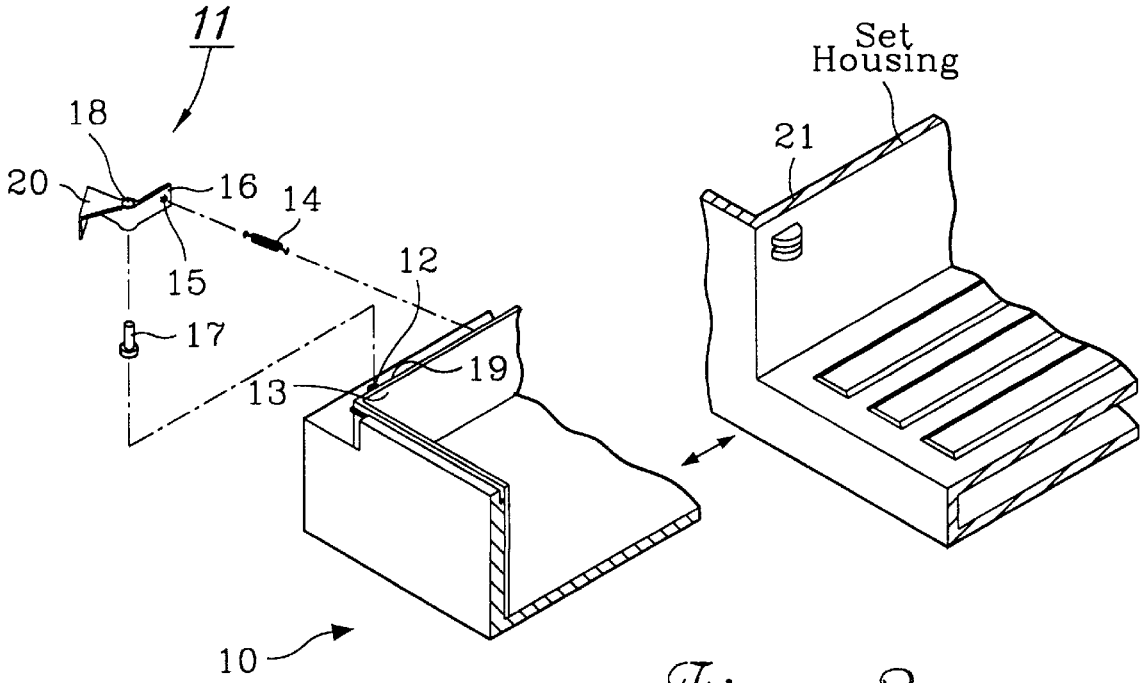
FIG. 2 is a perspective view showing a finger device of a feed cassette according to the present invention.
Figure 3:
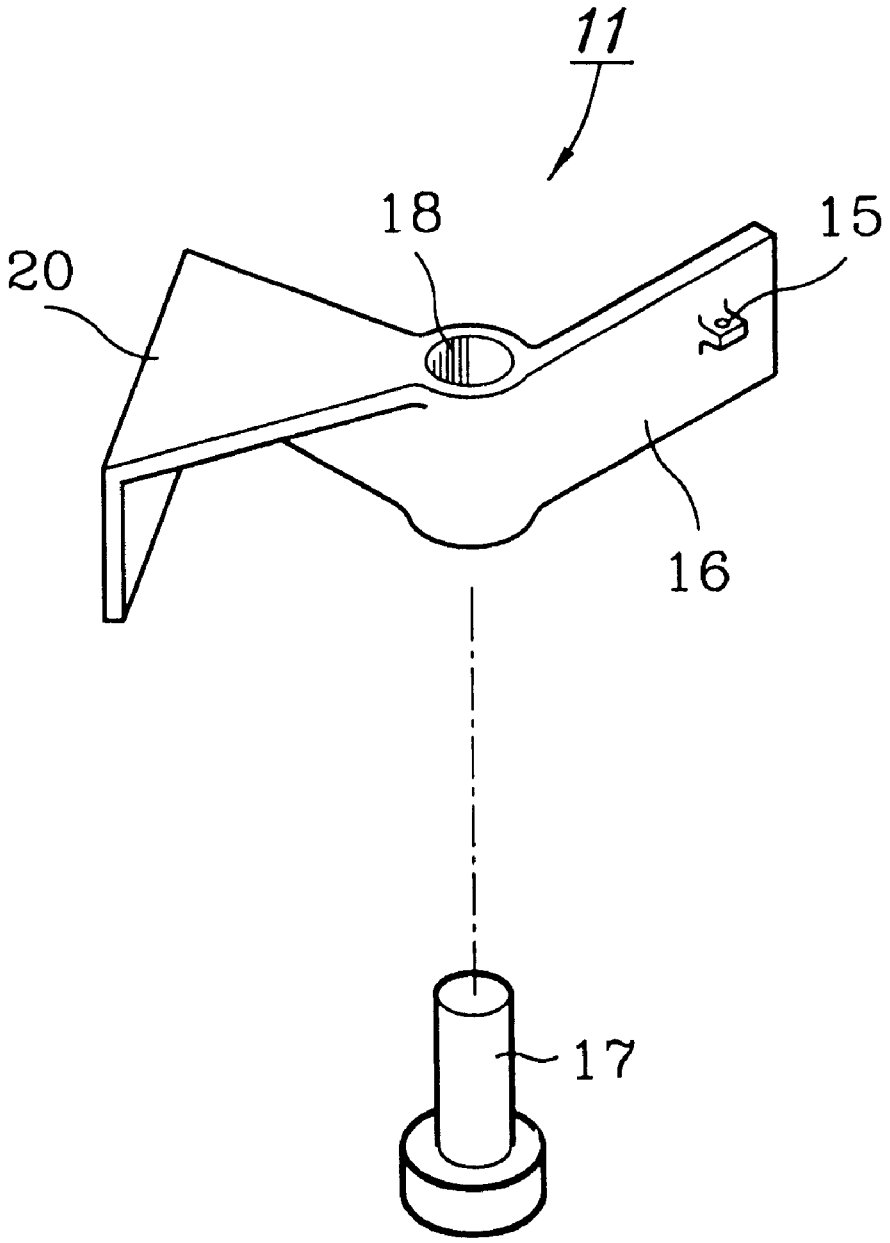
FIG. 3 is an enlarged perspective view showing the finger device as illustrated in FIG. 2.

FIG. 2 shows a finger device along with a feed cassette according to the present invention. FIG. 3 highlights the finger device as illustrated in FIG. 2. Therein, the feed cassette 10 includes a detaining hole 12 for installing the finger device 11 at an edge of the feed cassette 10, and a cassette gutter hook 19 for detaining one end of a spring 14 in a mold 13. The finger apparatus 11 can be manufactured by using molds. The finger apparatus 11 is provided with a detaining board 16 bent by a regular angle. A pin hole 18 inserts a hinge pin 17 in a bending portion of the detaining board 16. A finger gutter hook 15 detains the other end of a spring 14 on the surface of one side of the detaining board 16 centering around the pin hole 18. The finger apparatus 11 has a finger 20 shaped a triangle, for freely loading the papers in the feed cassette by bending at the other side of the detaining board 16, thereby covering an upper portion of the edge of the feed cassette 10. The bent angle of the detaining board 16 may be enough to separate the detaining board 16 from the mold 13 of the feed cassette 10 in the hinge pin 17 and a side portion of the finger 20 is made of a conductor When the feed cassette 10 is inserted in the apparatus capable of installing the feed cassette 10, the apparatus is provided with a protrusion 21 for pushing the finger 20 of the finger device 21 up to a position of separating by ones the papers while the feed cassette 10 is attached. At this time, the protrusion 21 made of the conductor is coupled to a paper sensor (not shown) in series, thereby sensing if or not the feed cassette 10 is inserted therein, and is shaped like a round into the direction of inserting the feed cassette 10 therein.

Figure 4:
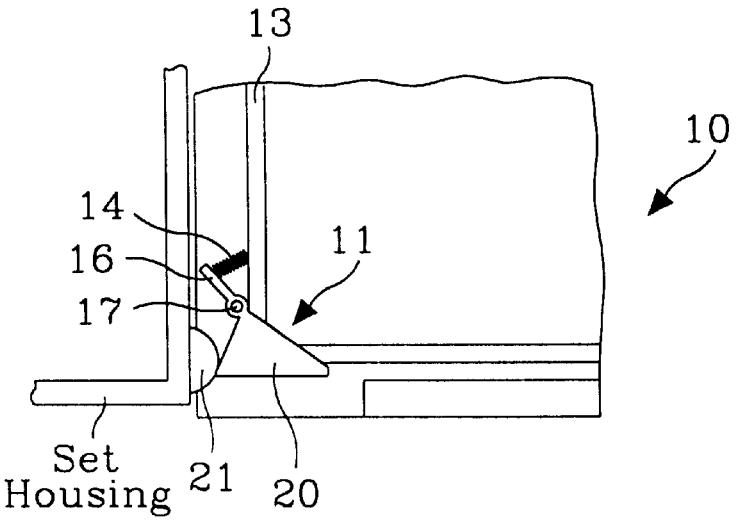
FIG. 4 illustrates the feed cassette where the finger device is installed according to the present invention.
Figure 5:
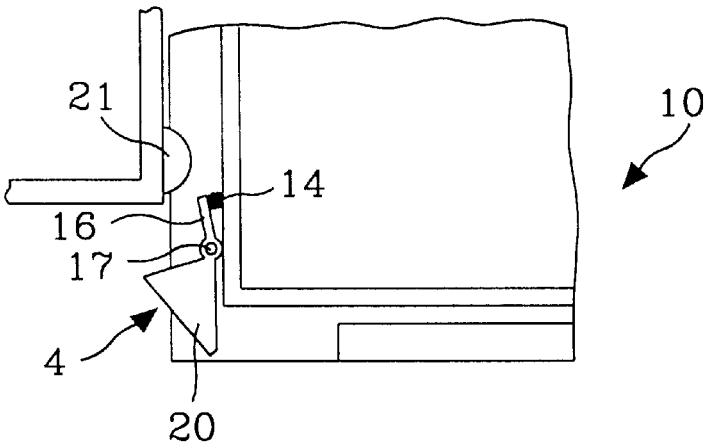
FIG. 5 illustrates the feed cassette where the finger device is separated according to the present invention.

Hereinafter, the operation and effect of the finger device constructed according to the principles of the present invention as described above, will be in detail explained with reference to FIGS. 4 and 5. Referring to FIGS. 4 and 5, the hinge pin 17 is inserted into the pin hole 18 of the finger device 1 1, one end of the spring 14 is fixed at the gutter hook 15 of the detaining board 16, the hinge pin 17 is inserted into the detaining hole 12 of the feed cassette 10, and the other end of the spring 14 is fixed at the mold 13 of the feed cassette 10 in a subsequent manner. At this time, the finger 20 of the finger device 1 1 is completely separated from the edge of the feed cassette 10.

As noted in the previous paragraphs, when the feed cassette 10 mounting the finger device 11 therein is inserted into the housing of the apparatus capable of installing the feed cassette, the protrusion 21 of the body of the apparatus is contacted with the side portion of finger 20 of the finger device 11. Then, the paper sensor senses the insertion of the feed cassette 10, so that the finger device 11 can be continuously rotated by the protrusion 21 centering around the hinge pin 17. Upon completion of insertion thereof, the finger 20 of the finger device 11 is located at the edge of the feed cassette 10 and also, the spring is extended. In this case, if the feed cassette 10 is separated from the apparatus to load the papers in the feed cassette 10, the finger device 11 is detached from the protrusion 21 and the extended spring 14 is restored, simultaneously. This results in the finger device 11 being located at its original position, so that the finger 20 of the finger device 11 can be automatically separated from the edge of the feed cassette 10.

As described above, the present invention has an advantage in that the papers can be freely loaded in the feed cassette. This is because the finger is automatically separated from inside of a tray by the spring and the insertion of the feed cassette can be sensed by the paper sensor coupled to the protrusion of the apparatus in series upon insertion of the feed cassette.

While the present invention has been described with reference to a specific embodiments, the description is illustrative of the invention and is not to be constructed as limiting the invention. Various modifications may occur to those skilled in the art without departing from the true spirit and scope of the invention as defined by the appended claims.

What is claimed is:

1. A printing apparatus being connectable to a feed cassette having space for printing papers, comprising:

a body of an image forming device having a housing for said feed cassette and printing images by imprinting ink onto the printing papers;

a finger device permitting a separation of the printing papers into ones upon an insertion of said feed cassette into said body, said finger device separable from an edge of said feed cassette upon a separation said feed cassette from said body; and a protrusion of a round shape and positioned adjacent to the space for said feed cassette, said protrusion pushing said finger device when said finger device permit the printing papers to separate.

2. The device as claimed in claim 1, wherein said protrusion is round on a direction of movement of said feed cassette during the insertion said feed cassette.

3. The device as claimed in claim 1, wherein said protrusion contains conductor material and is coupled in series to a paper sensor sensing whether said feed cassette is inserted, upon contacting said finger device.

4. The device as claimed in claim 3, wherein a contact portion of said finger device, being contactable with said protrusion, contains electrically conducting material.

5. The device as claimed in claim 1, wherein said feed cassette comprises:

a detaining hole permitting installation of said finger device by receiving a hinge pin;

a cassette gutter hook permitting installation of said finger device by detaining one end of a spring.

6. The device as claimed in claim 5, wherein said finger device comprises:

a detaining board bent by a predetermined angle and having a pin hole at a bending portion of said detaining board;

a finger gutter hook for detaining said spring on a surface of one side of said detaining board; and a triangular portion having a triangular shape and loading the printing papers of said feed cassette by rotating, thereby moving to an upper portion of an edge of said feed cassette.

7. The device as claimed in claim 6, wherein said detaining board of said finger device contains electrically conducting material.

8. A feed cassette, comprising:

a finger device for separating printing papers and loading the printing papers into said feed cassette, by latching a protrusion made of a conductor and formed at a body of apparatus accepting installation of said feed cassette;

a detaining hole for installing said finger device at an edge of said feed cassette; and a cassette gutter hook for detaining one end of a spring; wherein said finger device comprises:

a detaining board bent by a predetermined angle;

a pin hole for inserting a hinge pin in a bent portion of said detaining board;

a finger gutter hook for detaining said spring on a surface of one side of said detaining board; and a triangular portion having a triangular shape and loading the printing papers of said feed cassette by rotating, thereby moving to an upper portion of an edge of said feed cassette.

9. The feed cassette as claimed in claim 8, wherein said protrusion is coupled in series to a paper sensor, thereby sensing whether said feed cassette is inserted.

10. The feed cassette as claimed in claim 9, wherein a contact portion of said finger device contacted with said protrusion contains conductor material.

11. A feed cassette, comprising:

a finger device to separate printing papers for an image forming device forming images by imprinting the images onto the printing papers, and loading the printing papers into said feed cassette, by latching a protrusion made of a conductor and formed at a body of apparatus accepting installation of said feed cassette;

a detaining hole for installing said finger device at an edge of said feed cassette; and a cassette gutter hook for detaining one end of a spring.

12. The feed cassette of claim 11, wherein said finger device comprises:

a detaining board bent by a predetermined angle;

a pin hole for inserting a hinge pin in a bent portion of said detaining board;

a finger gutter hook for detaining said spring on a surface of one side of said detaining board; and a triangular portion having a triangular shape and loading the printing papers of said feed cassette by rotating, thereby moving to an upper portion of an edge of said feed cassette.

13. The feed cassette as claimed in claim 12, wherein said protrusion is coupled in series to a paper sensor, thereby sensing whether said feed cassette is inserted.

14. The feed cassette as claimed in claim 13, wherein a contact portion of said finger device contacted with said protrusion contains conductor material.

* * * * *